United States Patent [19]

Graul

[11] 4,156,221

[45] May 22, 1979

[54] AUDIO-FREQUENCY INJECTION TRANSFORMERS FOR RIPPLE CONTROL

[75] Inventor: Otto Graul, Bamberg, Fed. Rep. of Germany

[73] Assignee: Messwandler-Bau GmbH, Bamberg, Fed. Rep. of Germany

[21] Appl. No.: 834,053

[22] Filed: Sep. 16, 1977

[30] Foreign Application Priority Data

Sep. 20, 1976 [DE] Fed. Rep. of Germany ..... 2642216

[51] Int. Cl.[2] ..... H01F 27/02

[52] U.S. Cl. ..... 336/59; 336/60; 336/84 C; 336/92; 336/96; 336/234

[58] Field of Search ..... 336/90, 92, 96, 84 C, 336/60, 59, 55, 234, 57

[56] References Cited

U.S. PATENT DOCUMENTS

| | | | |
|---|---|---|---|
| 2,107,973 | 2/1938 | Bajon | 336/234 X |
| 2,516,140 | 7/1950 | Nahman | 336/234 X |
| 2,701,865 | 2/1955 | Getz et al. | 336/234 X |
| 2,962,679 | 11/1960 | Stratton | 336/234 X |
| 3,222,625 | 12/1965 | Ledocq | 336/96 X |
| 3,265,998 | 8/1966 | Park | 336/96 X |
| 3,949,338 | 4/1976 | Burson | 336/96 X |
| 4,035,751 | 7/1977 | Walthew | 336/234 X |

*Primary Examiner*—Thomas J. Kozma
*Attorney, Agent, or Firm*—Craig & Antonelli

[57] ABSTRACT

A coupling transformer for networks with superimposed audio frequency voltage, especially for ripple control systems, with primary and secondary windings rigidly coupled with each other and arranged about an iron core; the primary and secondary windings surround one another coaxially and are separated and insulated from one another by a cast resin insulation, whereby only one of the two windings is embedded in the cast resin insulation while the other, freely accessible winding coaxially surrounds the iron core constructed as rod-type core under formation of at least one cooling channel; an electric shield is additionally provided between the two windings.

34 Claims, 3 Drawing Figures

AUDIO-FREQUENCY INJECTION TRANSFORMERS FOR RIPPLE CONTROL

The present invention relates to ripple control systems and more particularly to coupling or injection transformers for such ripple control systems.

Coupling transformers for networks with a superimposed audio-frequency voltage for the audio-frequency ripple control are used under integration of the 50-Hz power distribution network for the purpose of triggering synchronous switching operations at any desired time and at any desired location by way of audio-frequency receivers. Consequently, audio-frequency ripple control systems are excellent for load control and are suitable for the rationalization of the operation of electric power supply enterprises.

The pulse injection apparatus for audio-frequency ripple control systems can be constructed differently depending on the ripple control system. One thereby differentiates between the parallel and series coupling whereby the series coupling may be constructed either as transformer operating according to the reactor principle or as transformer operating according to the current transformer principle.

Prior art coupling transformers which operate according to the current transformer principle possess customarily a closed iron core devoid of air gaps, over which is mounted uniformly distributed the primary winding which is inserted into the power line. The secondary winding, which is arranged coaxially to the primary winding and which is connected with the transmitter, is separated from the primary winding by a cast resin insulation. The transformer body of the transformer operating according to the current transformer principle is surrounded by a metallic housing insofar as it is stressed by the secondary winding, whereby the space between the housing and the secondary winding is cast out with a casting resin for the better heat transfer and for strengthening the secondary winding with respect to short-circuit loads (see brochure "25 Years Messwandler-Bau GmbH., Bamberg," 1971, page 36–37).

Prior art coupling transformers which operate according to the reactor principle possess customarily a frame-shaped iron core with air gaps uniformly distributed in both cross legs. The secondary winding and the primary winding consist each of two winding halves arranged on the cross legs of the iron core, which are connected with each other in series. The secondary winding halves which are connected with the transmitter, surround the cross legs of the iron core directly. The primary, high-voltage winding halves arranged coaxially thereto are insulated from the corresponding secondary winding halves by a cast resin insulation. Also, in this coupling transformer, the transformer body is surrounded by a metal housing in order to be able to use the apparatus in outdoor applications. Additionally, the lead-in insulating parts of the apparatus of bushing-type construction are surrounded by porcelain insulators whereby the hollow space between these insulator parts constructed as coaxial parts are advantageously foamed out (see brochure, "25 Years Messwandler-Bau GmbH., Bamberg," 1971, pages 37–38).

The aforementioned coupling or injection transformers have proved themselves in practice over a large number of years and have been manufactured in large quantities.

Accordingly, the present invention relates to a coupling or injection transformer for networks with superimposed audio-frequency voltage, especially for ripple control systems, with secondary and high-voltage primary windings fixedly coupled with one another and arranged about an iron core, whereby the secondary and primary windings surround one another coaxially and are separated and insulated from one another by a cast resin insulation.

The present invention is concerned with the task to so construct a coupling transformer of the aforedescribed type that the power in the primary winding and the duration of operation thereof is increased compared to the known apparatus of this type. Furthermore, the manufactured of the cast resin insulation between the primary and secondary winding is to be simplified.

The underlying problems are solved according to the present invention in that exclusively one of the two windings is embedded in a cast resin insulation whereas the other, freely accessible winding surrounds coaxially the iron core constructed as rod-type core under formation of at least one cooling channel and in that an electric shield is provided between the secondary and primary winding.

By reason of the fact that only one of the two windings is embedded in a cast resin insulation, several advantages are obtained simultaneously. Thus, at the outset, the quantity of the cast resin is noticeably reduced compared to the prior art coupling or injection transformers, which reduces the danger of insulation defects. The winding which is not provided with a cast resin insulation, is freely accessible for an effective self-ventilation or external ventilation. Also, the freely accessible winding can be manufactured as preassembled finished part, can be pretested and can be installed in a simple manner. The iron core constructed as rod-type core which has a considerably reduced weight, possesses analogous properties as an air gap core. As a result thereof, the coupling transformer according to the present invention can be used for the transformer coupling, in which the current in the primary winding effects a 50 Hz magnetization of the iron core which is not compensated by a resonant circuit on the transmitter side, as with the transformer coupling operating according to the current transformer principle. Therebeyond, with the rod-type core construction, the expenditure for the correct adjustment and fixing of the air gaps is dispensed with as is required with the prior art coupling transformer operating according to the reactor principle.

It is of particular advantage if the secondary winding which is connected to the transmitter, is embedded in the cast resinous insulation whereas the primary winding which is interconnected into the power network, is constructed as open-layer winding and surrounds the rod-type core under maintenance of several cooling channels. Since the secondary winding is tuned to the data of the transmitter, it always includes the same winding data for a predetermined transmitter. A rational spare part manufacture can be provided therewith. Eventual matching actions can be undertaken by way of the freely accessible primary winding which is adapted to be installed in a simple manner and therewith is also exchangeable.

It is also favorable if the rod-type core is constructed as cylinder core with radial sheet-metal sheetings. A rod-type core constructed in this manner possesses practically no eddy current losses.

Accordingly, it is an object of the present invention to provide a coupling transformer for networks with superimposed audio-frequency voltage, especially for ripple control systems, which avoids by simple means the aforementioned shortcomings and drawbacks encountered in the prior art.

Another object of the present invention resides in a coupling transformer for networks with superimposed audio-frequency voltage which reduces the costs of manufacture as well as the danger of defects in the insulation.

A further object of the present invention resides in a coupling transformer for ripple control systems which enables an effective ventilation by simple means while simultaneously reducing the weight thereof.

A still further object of the present invention resides in a coupling transformer of the type described above which permits the manufacture of preassembled and pretested parts and simultaneously facilitates the assembly and repair of the finished products.

These and further objects, features, and advantages of the present invention will become more apparent from the following description when taken in connection with the accompanying drawing which shows, for purposes of illustration only, one embodiment in accordance with the present invention, and wherein.

Figure 1:
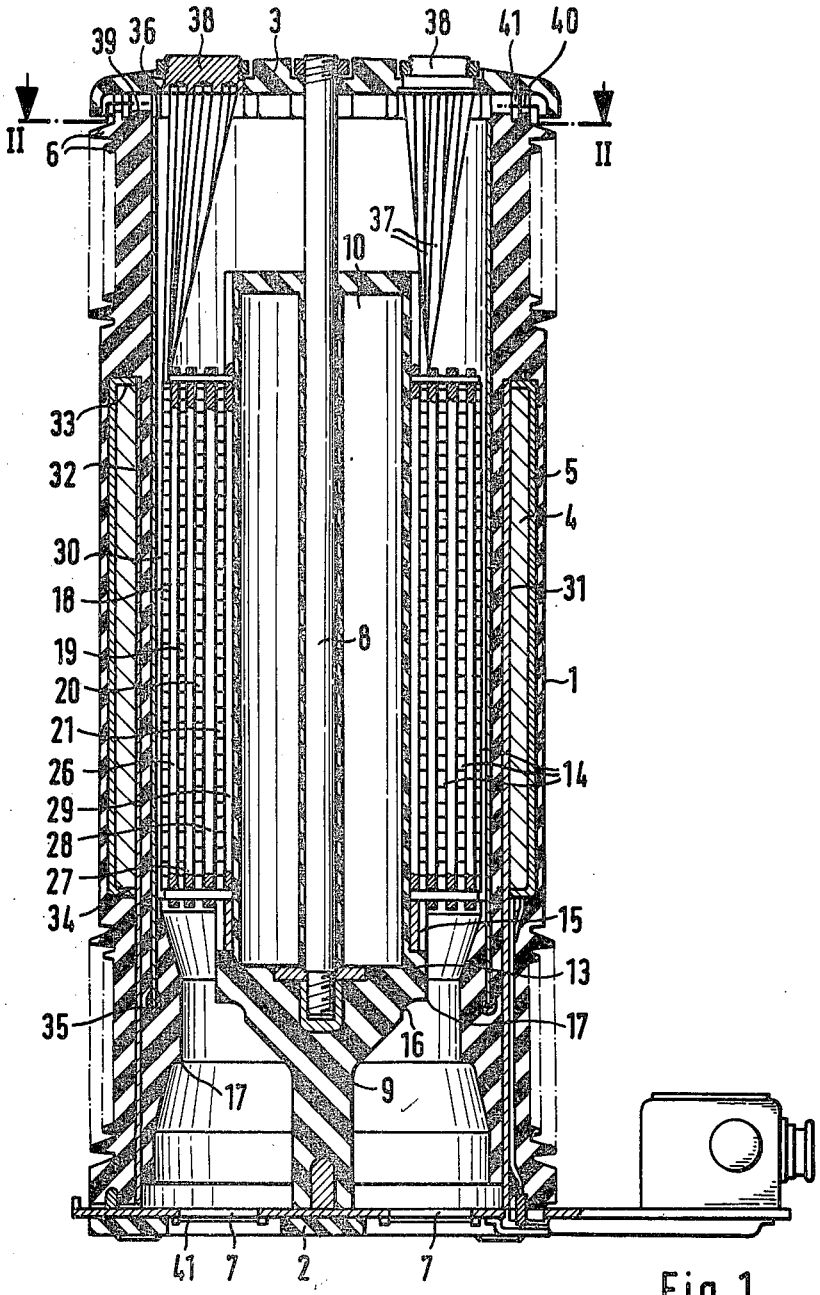
FIG. 1 is a longitudinal cross-sectional view through a coupling transformer according to the present invention.

Referring now to the drawing wherein like reference numerals are used throughout the various views to designate like parts, and more particularly to FIG. 1, the coupling transformer according to the present invention is of the so-called bushing or pin-type construction. Insofar as the active parts are not contained in the insulating casing 1 itself, they are accommodated in the cylindrical opening of the insulating casing 1. A base 2 and a cover hood 3 are so constructed that the coupling transformer is also suitable for outdoor use.

The insulating casing 1 consists preferably of an open-air-resistant cast resin, for example, of one of the known cyclo-aliphatic resins. The secondary or transmitter winding which is connected with the transmitter and is tuned in its electric data to the transmitter, is embedded in the insulating casing 1 under use of a customary padding 5. The insulating casing 1 is extended in the direction of the longitudinal axis of the coupling transformer in the upward and downward direction beyond the ends of the transmitter or secondary winding 4, whereby the areas projecting beyond the transmitter winding 4 are provided with ribs 6 having preferably different rib projections or radial lengths for the increase of the surface leakage path. If the voltage level should so require, of course, also the area of the insulating casing 1 containing the transmitter or secondary winding 4 could be provided with ribs.

The base 2 of light-weight construction is provided with several air inlet openings 7 having a sufficient cross section for an intensive cooling of the active parts which are preferably arranged in the shape of a circle relative to one another. The cover hood 3 which preferably also consists of an outdoor resistant cast resin, is clamped together with a support insulator 9 for the iron core 10 by means of a central bolt 8 and with the base 2 by way of the support insulator 9.

Figure 3:
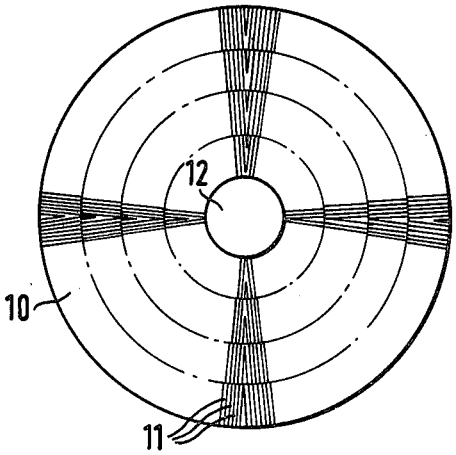
FIG. 3 is a plan view on the cylindrical rod-type core in accordance with the present invention.

As is shown in particular from FIG. 3, the iron core 10 is constructed as cylindrical rod-type core with sheet metal plates 11 extending radially to the core axis. The sheet metal members 11 are stepped or offset in their length preferably several times, in the illustrated embodiment are stepped or offset four times in order to obtain a high sheet-metal space factor. The core opening 12 is provided for the extension therethrough of the central bolt 8. The small gaps remaining between the sheet metal members 11 are filled out with casting resin which also surrounds the outer circumference of the rod-type core 10 with a slight layer thickness. The support insulator 9 is preferably cast integral in one and the same operation during the casting-out of the core gaps in order to achieve a sufficiently rigid connection between the rod-type core 10 and the support insulator 9. The rod-type core 10 is supported at the base 2 of the coupling transformer by way of the support insulator 9, whereby preferably a disengageable threaded connection is provided between these parts.

At its upper free end, the support insulator 9 is provided with a circumferential flange 13 surrounding the rod-type core 10 which is constructed as support surface for the primary winding 14 and/or corresponding spacer members 15. The support insulator 9 advantageously tapers somewhat in the direction toward the base 2 and includes a fillet 16 which terminates in a circumferential dripping edge 17 for perspiration or condensation water.

The network or primary winding 14 is preferably constructed as open layer winding, whose individual layers 18, 19, 20 and 21 are kept at a distance to one another by spacer members 22, 23, 24 and 25 (FIG. 2) for purposes of forming cooling channels 26, 27, 28 and 29. A further cooling channel 30 may be provided between the outermost layer 18 of the network or primary winding 14 and an electric shield 32 delimiting the inner surface 31 of the insulating casing 1. The electric shield 32 is constructed as cylinder of electrically conducting or semi-conducting material which is slotted along its circumference. The shield 32, however, need not be constructed as a sheet metal part made by itself; it is also possible to provide the inner surface 31 of the insulating casing 1 with a corresponding conducting or semi-conducting coating. The shield 32 is extended in the upward and downward direction far beyond the end faces 33 and 34 of the transmitter or secondary winding 4, whereby the lower end 35 of the shielding cylinder 32 extends approximately up to the dripping edge 17 of the support insulator 9. The upper end 36 of the shielding cylinder 32 is extended upwardly approximately to the upper end of the insulating casing 1.

The lead-out lines 37 (FIG. 2) of the network or primary winding 14 are constructed as flexible lines and are extended up to the connections 38 in the cover hood 3 also made of outdoor resistant synthetic resin. The flexible connecting lines 37 can be secured by conventional clamping devices against unintentional displacement.

Figure 2:
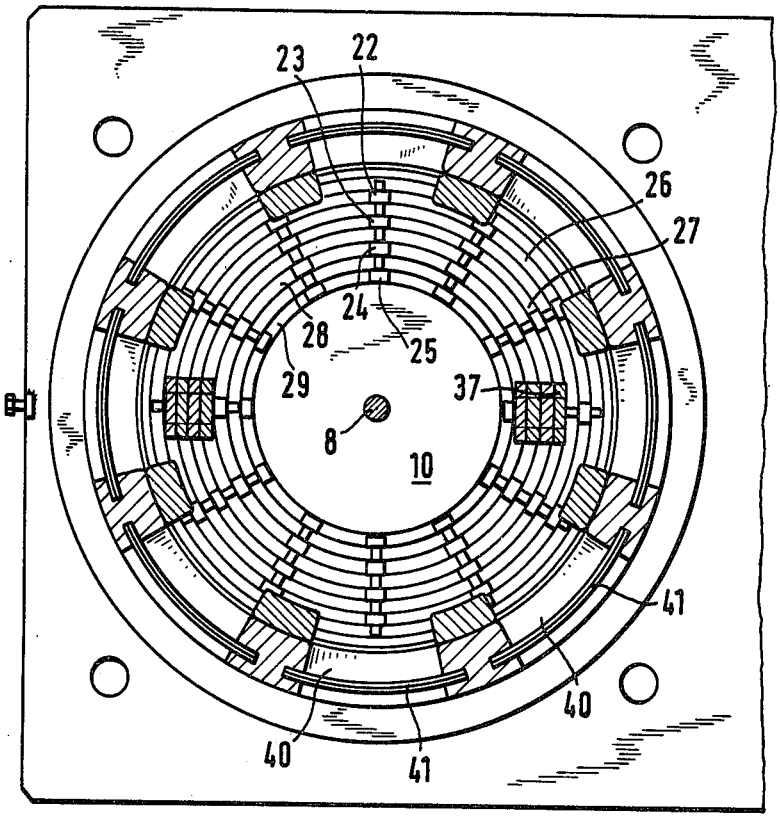
FIG. 2 is a cross-sectional view through the coupling transformer of FIG. 1, taken along II—II of FIG. 1.

In order to permit to the cooling air flowing-in through the openings 7 in the base 2 an unimpaired passage through the active parts of the coupling transformer according to the present invention, the free upper end 39 of the insulating casing 1 is provided with cooling air discharge openings 40 which are shown in FIGS. 1 and 2. The discharge openings 40, as also the air inlet openings 7, may also be closed off by means of an air-permeable mesh work 41 in order to prevent the undesired penetration of foreign bodies.

Even though in the preceding described embodiment of the present invention the transmitter or secondary winding 4 is embedded in the insulating casing 1 and the network or primary winding 14 is provided as freely accessible and therewith readily interchangeable winding adapted to be well-ventilated, a modified construction with interchanged network (primary) and transmitter (secondary) windings is also quite feasible and realizable in accordance with the present invention.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. Coupling transformer for networks with heterodyne audio-frequency voltage, especially audio-frequency systems, having transmission and supply windings which are arranged about an iron core and firmly coupled to each other within a housing having openings to enable a flow of air into and out of the housing, wherein the transmission and the supply windings enclose each other coaxially and are mutually separated and insulated by a cast resin insulating means, characterized in that the iron core is formed as a cylindrical rod core with radial lamination; that only one of the two windings is embedded in a cast resin insulating means whereas the other winding is freely accessible on both end faces and coaxially encloses the iron core, said winding having at least one continuous cooling channel open at both ends to enable said flow of air to pass therethrough; that the lower end face of the iron core is borne by a base insulator which supports the iron core on the one hand, and which is also provided as a support for the freely accessible winding on the other hand; that an electrical shielding means is placed between the transmission and the supply windings.

2. A coupling transformer according to claim 1, characterized in that the iron core means is constructed as rod-type core.

3. A coupling transformer according to claim 2, characterized in that the coupling transformer is for audio-frequency ripple control systems.

4. A coupling transformer according to claim 2, characterized in that the secondary winding means is embedded in the cast resin insulation whereas the primary winding means is constructed as open-layer winding and surrounds the iron core means under maintenance of several cooling channel means.

5. A coupling transformer according to claim 4, characterized in that the iron core means is constructed as cylinder core having radial sheet metal means.

6. A coupling transformer according to claim 5, characterized in that the sheet metal length of the radial sheet metal means is stepped at least once.

7. A coupling transformer according to claim 6, characterized in that the sheet metal length of the radial sheet metal means is stepped several times.

8. A coupling transformer according to claim 6, characterized in that the gaps between the radial sheet metal means are filled out with cast resin.

9. A coupling transformer according to claim 8, characterized in that a support insulator means is cast onto the lower end face of the iron core means, the iron core means being supported at a base means of the coupling transformer by way of the support insulator means.

10. A coupling transformer according to claim 9, characterized in that the primary winding means surrounding the iron core means is supported at a flange-like offset free end of the support insulator means.

11. A coupling transformer according to claim 10, characterized in that the support insulator means tapers conically in the direction toward the base means and is provided with a circumferential dripping edge.

12. A coupling transformer according to claim 11, characterized in that the electric shield means is constructed as cylinder abutting at the inner surface of the cast resin insulation of the corresponding winding means.

13. A coupling transformer according to claim 12, characterized in that the shield cylinder projects on both sides beyond the end faces of at least one of the winding means, the lower end of the shield cylinder being extended to about the dripping edge of the support insulator means.

14. A coupling transformer according to claim 13, characterized in that lead-out line means of the primary winding means are constructed as flexible lines and are extended to connections in a cover hood means of the coupling transformer.

15. A coupling transformer for networks with superimposed audio frequency voltage, comprising secondary and primary winding means securely coupled with one another and arranged about an iron core means which are operable to be connected respectively to a transmitter and to an electric power network, the secondary and primary winding means surrounding one another substantially coaxially and being separated and insulated from one another by a cast resin insulation, characterized in that exclusively one of the two winding means is embedded in a cast resin insulation whereas the other, essentially freely accessible winding means surrounds substantially coaxially the iron core means under formation of at least one cooling channel means, and an electric shield means provided between the secondary and primary winding means, in that the iron core means is constructed as rod-type core, in that the secondary winding means is embedded in the cast resin insulation whereas the primary winding means is constructed as open-layer winding and surrounds the iron core means under maintenance of several cooling channel means, in that the iron core means is constructed as cylinder core having radial sheet metal means, in that the sheet metal length of the radial sheet metal means is stepped at least once, in that the gaps between the radial sheet metal means are filled out with cast resin, in that a support insulator means is cast onto the lower end face of the iron core means, the iron core means being supported at a base means of the coupling transformer by way of the support insulator means, in that the primary winding means surrounding the iron core means is supported at a flange-like offset free end of the support insulator means, in that the support insulator means tapers conically in the direction toward the base means and is provided with a circumferential dripping edge, in that the electric shield means is constructed as cylinder abutting at the inner surface of the cast resin insulation of the corresponding winding means, in that the shield cylinder projects on both sides beyond the end faces of at least one of the winding means, the lower end of the shield cylinder being extended to about the dripping edge of the support insulator means, in that lead-out line means of the primary winding means are constructed as flexible lines and are extended to connections in a cover hood means of the coupling transformer, and in that the cast resin insulation surrounding the secondary winding means is constructed as insulating casing whose two ends are provided with ribs.

16. A coupling transformer according to claim 15, characterized in that the insulating casing includes ribs only at the ends free of windings.

17. A coupling transformer according to claim 15, characterized in that the insulating casing consists of outdoor-resistant cast resin.

18. A coupling transformer according to claim 17, characterized in that the upper end of the insulating casing is provided with cooling air discharge openings.

19. A coupling transformer according to claim 18, characterized in that the cover hood means which essentially consists of outdoor resistant cast resin, is clamped together with the insulating casing by way of a central bolt extending through the iron core means and secured at the support insulator means.

20. A coupling transformer according to claim 1, characterized in that the secondary winding means is embedded in the cast resin insulation whereas the primary winding means is constructed as open-layer winding and surrounds the iron core means under maintenance of several cooling channel means.

21. A coupling transformer according to claim 1, characterized in that the iron core means is constructed as cylinder core having radial sheet metal means.

22. A coupling transformer according to claim 21, characterized in that the sheet metal length of the radial sheet metal means is stepped at least once.

23. A coupling transformer according to claim 21, characterized in that the gaps between the radial sheet metal means are filled out with cast resin.

24. A coupling transformer according to claim 1, characterized in that a support insulator means is cast onto the lower end face of the iron core means, the iron core means being supported at a base means of the coupling transformer by way of the support insulator means.

25. A coupling transformer according to claim 24, characterized in that the primary winding means surrounding the iron core means is supported at a flange-like offset free end of the support insulator means.

26. A coupling transformer according to claim 24, characterized in that the support insulator means tapers conically in the direction toward the base means and is provided with a circumferential dripping edge.

27. A coupling transformer according to claim 1, characterized in that the electric shield means is constructed as cylinder abutting at the inner surface of the cast resin insulation of the corresponding winding means.

28. A coupling transformer according to claim 27, characterized in that the shield cylinder projects on both sides beyond the end faces of at least one of the winding means, the lower end of the shield cylinder being extended to about a dripping edge of a support insulator means.

29. A coupling transformer according to claim 1, characterized in that lead-out line means of the primary winding means are constructed as flexible lines and are extended to connections in a cover hood means of the coupling transformer.

30. A coupling transformer according to claim 1, characterized in that the cast resin insulation surrounding the secondary winding means is constructed as insulating casing whose two ends are provided with ribs.

31. A coupling transformer according to claim 30, characterized in that the insulating casing includes ribs only at the ends free of windings.

32. A coupling transformer according to claim 30, characterized in that the insulating casing consists of outdoor-resistant cast resin.

33. A coupling transformer for networks with superimposed audio frequency voltage, comprising secondary and primary winding means securely coupled with one another and arranged about an iron core means which are operable to be connected respectively to a transmitter and to an electric power networks, the secondary and primary winding means surrounding one another substantially coaxially and being separated and insulated from one another by a cast resin insulation, characterized in that exclusively one of the two winding means is embedded in a cast resin insulation whereas the other, essentially freely accessible winding means surrounds substantially coaxially the iron core means under formation of at least one cooling channel means, and an electric shield means provided between the secondary and primary winding means, in that the cast resin insulation surrounding the secondary winding means is constructed as insulating casing whose two ends are provided with ribs, and in that the upper end of the insulating casing is provided with cooling air discharge openings.

34. A coupling transformer for networks with superimposed audio frequency voltage, comprising secondary and primary winding means securely coupled with one another and arranged about an iron core means which are operable to be connected respectively to a transmitter and to an electric power network, the secondary and primary winding means surrounding one another substantially coaxially and being separated and insulated from one another by a cast resin insulation, characterized in that exclusively one of the two winding means is embedded in a cast resin insulation whereas the other, essentially freely accessible winding means surrounds substantially coaxially the iron core means under formation of at least one cooling channel means, and an electric shield means provided between the secondary and primary winding means, in that the cast resin insulation surrounding the secondary winding means is constructed as insulating casing whose two ends are provided with ribs, and in that a cover hood means which essentially consists of outdoor resistant cast resin, is clamped together with an insulating casing forming part of the insulation by way of a central bolt extending through the iron core means and secured at a support insulator means.

* * * * *